US005093966A

United States Patent [19]

Yuki et al.

[11] Patent Number: 5,093,966

[45] Date of Patent: Mar. 10, 1992

[54] PULL TAB ASSEMBLY FOR SLIDE FASTENER SLIDER

[75] Inventors: Kenji Yuki, Toyama; Susumu Ishii, Kurobe, both of Japan

[73] Assignee: Yoshida Kogyo K. K., Tokyo, Japan

[21] Appl. No.: 633,685

[22] Filed: Dec. 26, 1990

[30] Foreign Application Priority Data

Dec. 28, 1989 [JP] Japan ..... 1-152517[U]

[51] Int. Cl.[5] ..... A44B 19/26

[52] U.S. Cl. ..... 24/429; 24/419

[58] Field of Search ..... 24/429, 419, 430, 431; 294/3.6

[56] References Cited

U.S. PATENT DOCUMENTS

| | | | |
|---|---|---|---|
| 2,495,176 | 1/1950 | Nissen | 24/429 |
| 2,983,017 | 5/1961 | Harmon | 24/419 |
| 3,836,189 | 9/1974 | Borrelli | 294/3.6 |
| 3,852,852 | 12/1974 | Watanabe | 24/419 |
| 4,137,609 | 2/1979 | Kedzierski | 24/419 |
| 4,768,263 | 9/1988 | Fukuroi et al. | 24/419 |
| 4,873,750 | 10/1989 | Tracy | 24/429 |
| 4,920,615 | 5/1990 | Aoki et al. | 24/429 |

FOREIGN PATENT DOCUMENTS

| | | | |
|---|---|---|---|
| 0089695 | 3/1983 | European Pat. Off. . | |
| 0338545 | 4/1988 | European Pat. Off. . | |
| 2907232 | 9/1979 | Fed. Rep. of Germany | 24/429 |
| 3723766 | 7/1987 | Fed. Rep. of Germany . | |
| 0161221 | 11/1957 | Sweden | 24/419 |

*Primary Examiner*—Victor N. Sakran

*Attorney, Agent, or Firm*—Hill, Van Santen, Steadman & Simpson

[57] ABSTRACT

A pull tab assembly for slide fastener slider is disclosed, which comprises a clamper having at one of its ends a hook, a resilient member supported in the hook and a pull tab having a pair of ears which each have such a geometry that can facilitate mounting and dismounting of the pull tab with respect to the clamper and further protect the resilient member against deformation or damage.

5 Claims, 4 Drawing Sheets

PULL TAB ASSEMBLY FOR SLIDE FASTENER SLIDER

BACKGROUND OF THE INVENTION

Field of the Invention

This invention relates to a pull tab assembly removably mounted on and adapted to manipulate a slider in opening and closing a slide fastener.

Related Invention

The present invention is an improvement in and relating to the invention disclosed in U.S. Pat. No. 4,920,615 to the same assignee, Yoshida Kogyo K. K., Tokyo, Japan.

Prior Art

A slider pull tab disclosed in U.S. Pat. No. 4,920,615 is represented in FIGS. 6–8 inclusive of the accompanying drawings and shown comprising a clamper 100 pivotally connected to a trunnion 101 on a slider body 102, a hook 103 extending from one end of the clamper 100 and having an aperture 104, a resilient member 105 disposed at the lower portion of the hook 103 and normally closing off the aperture 104 of the hook 103 and a pull tab 106 having an annular link 107 for connecting the pull tab 106 to the clamper 100. While this prior pull tab device has many of its inherent advantages, it has now been found that the resilient member 105 is susceptible to deformation leading to loss of its elastic action, if not to physical damage, when subjected to pressure exerted by the annular link 107 rotating in contact with the resilient member 105 as for example in the case of ironing the garment to which the slide fastener is attached.

SUMMARY OF THE INVENTION

It is therefore a primary object of the present invention to provide an improved pull tab assembly for slide fastener slider which incorporates structural features tailored to eliminate the foregoing drawbacks of the prior art.

More specifically, the pull tab assembly according to the invention includes means of maintaining a pull tab out of contact with a resilient member even when the pull tab is oriented to underlie a clamper.

The pull tab assembly according to the invention further includes means of facilitating connection and disconnection of the pull tab with respect to a clamper.

The pull tab assembly of the invention also includes means of preventing undue lateral rocking movement of the pull tab.

According to the ivnention, there is provided a pull tab assembly for slide fastener slider which comprises a clamper including an arcuate peripheral wall defining therein an aperture and a transverse bridge linking the confronting ends of the peripheral wall, a hook extending from the confronting ends and having its distal end terminating short of the bridge so as to define an opening, a resilient member supported in the hook, and a pull tab provided at one end with a pair of spaced ears interconnected by a pin, each of the ears having side peripheral walls and an end surface merging through corners with the side walls, and each of the ears having a geometry such that a distance as measured between the end surface and a tangent line of the pin extending in parallel with the end surface is smaller than the width of the opening of the hook and that a distance as measured between the side wall adjoining the corner and a tangent line of the pin extending at right angles to the end surface is larger than the width of the opening.

The above and other features and advantages of the present invention will appear clear from the following detailed description taken in conjunction with the accompanying drawings which illustrate by way of example a preferred embodiment.

DETAILED DESCRIPTION OF THE INVENTION

Figure 1:
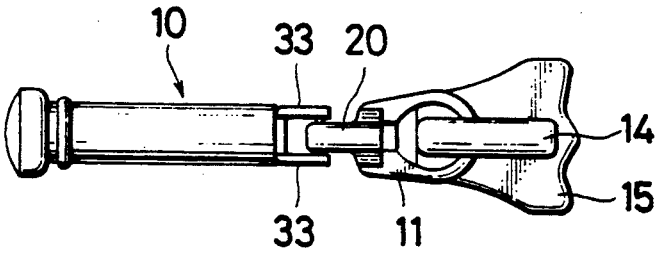
FIG. 1 is a plan view of a pull tab assembly embodying the invention.

Referring now to the drawings and firstly FIG. 1, there is shown a pull tab assembly 10 which comprises a clamper 11 and a pull tab 12 releasably connected thereto by a hook 20, the clamper 11 being pivotally connected to a connecting lug or trunnion 14 on a slider body 15 in a well known manner.

Figure 2:
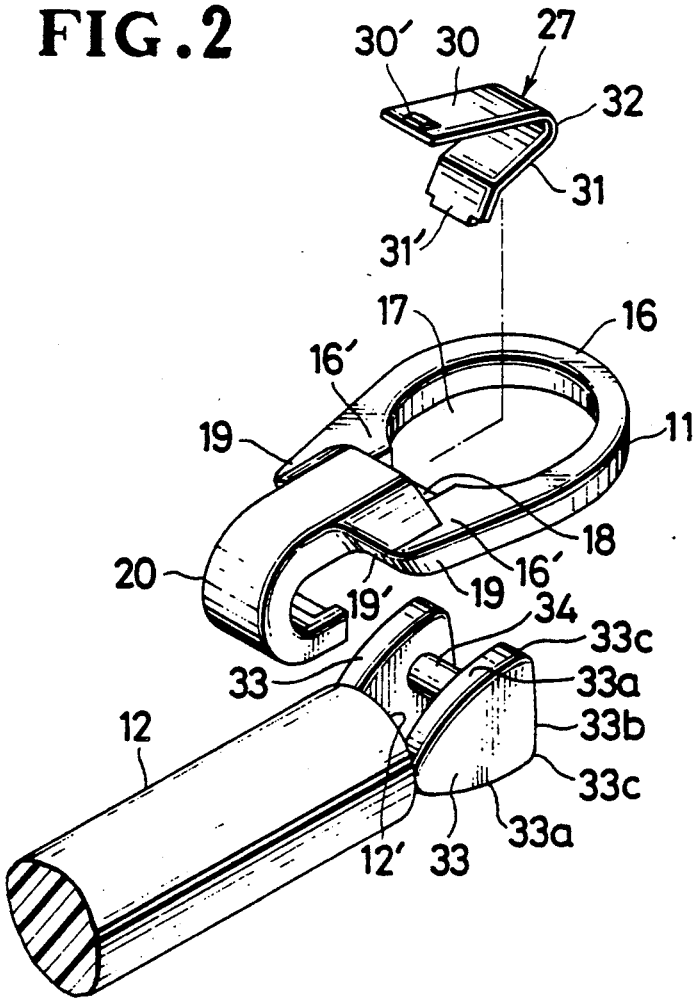
FIG. 2 is an exploded, perspective view on enlarged scale of the assembly.

As better shown in FIG. 2, the clamper 11 includes an arcuate peripheral wall 16 defining therein an aperture 17 through which the trunnion 14 of the slider body 15 is loosely fitted for pivotal connection of the clamper 11 and a transverse bridge 18 linking the confronting ends 16', 16' of the arcute peripheral wall 16, at which ends are formed shoulders 19, 19 having respective tapered guide surfaces 19', 19'. A hook 20 formed integral with the arcuate peripheral wall 16 has an upper straight wall 21 extending integrally from the confronting ends 16', 16' of the arcuate peripheral wall 16, a lower straight wall 22 and an arcuate wall 23 integrally interconnecting the upper and lower walls 21 and 22 and defining therewith a substantially U-shaped aperture 24 extending transversely of the pull tab body 12. The lower wall 22 of the hook 20 has its distal end terminating short of the transverse bridge 18 so as to define an opening 25 communicating with the aperture 24 and adapted to bring the clamper 11 into and out of engagement with the hook 20. The upper wall 21 of the hook 20 is raised above the level of the arcuate peripheral wall 16 so as to define an opening 26 through which a resilient member 27 is mounted in place in a manner hereafter described.

Figure 3:
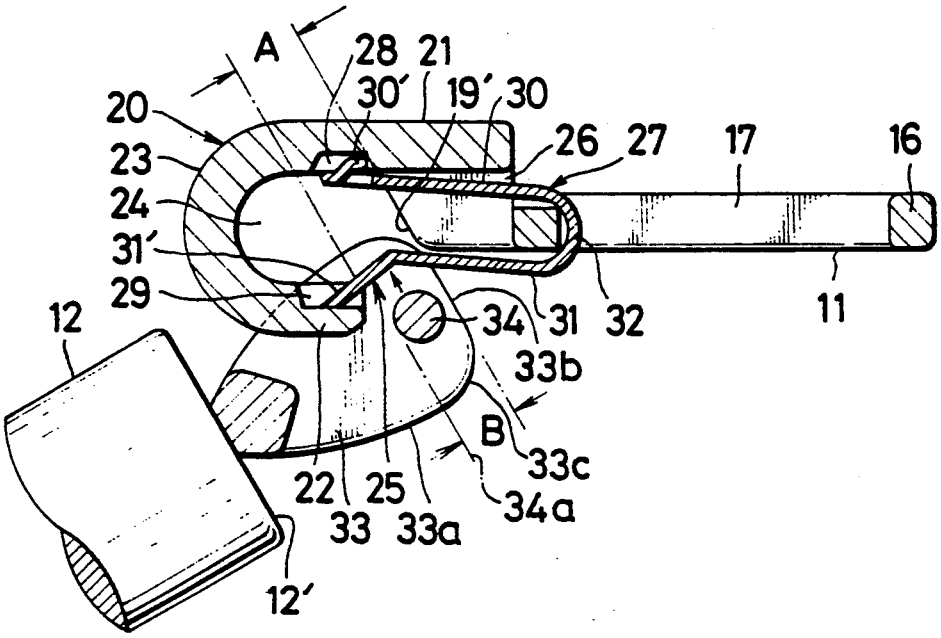
FIG. 3 is a cross-sectional view of part of the assembly shown in one operative position.
Figure 4:
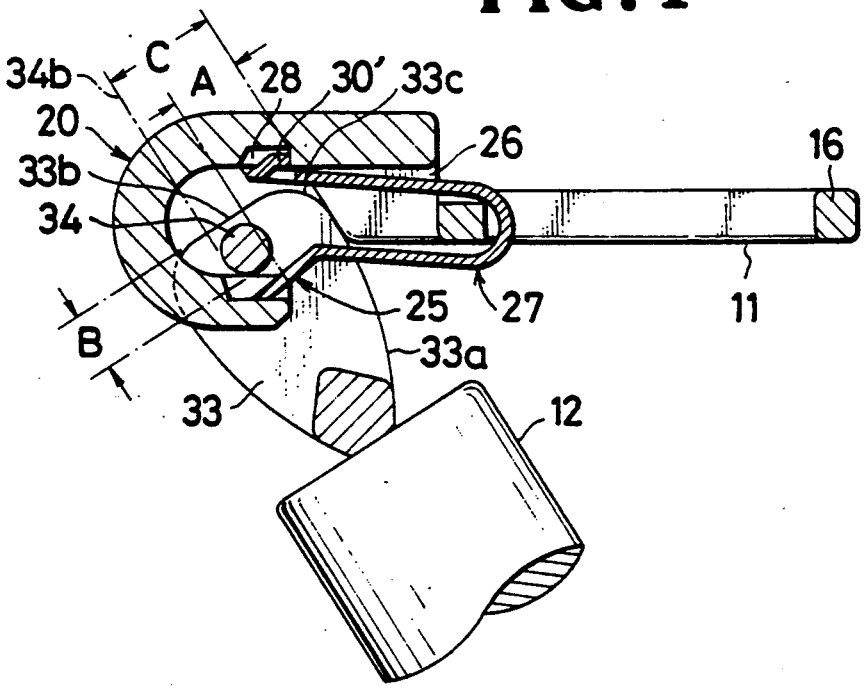
FIG. 4 is a view similar to FIG. 3 but showing the assembly in another operative position.
Figure 5:
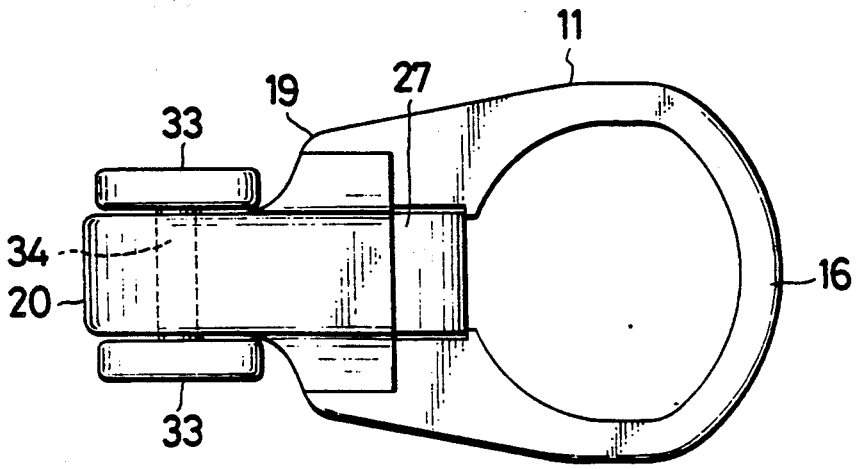
FIG. 5 is a plan view on further enlarged scale of the pull tab assembly shown in fully assembled condition.
Figure 6:
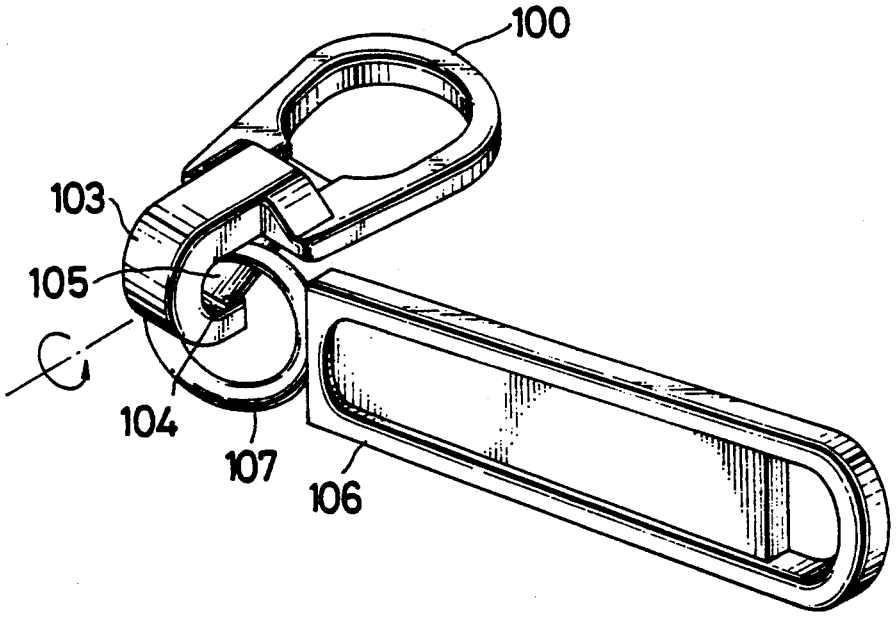
FIG. 6 RELATED ART
FIGS. 6, 7 and 8 inclusive are views utilized to explain the construction and operation of a prior art pull tab assembly.
Figure 7:
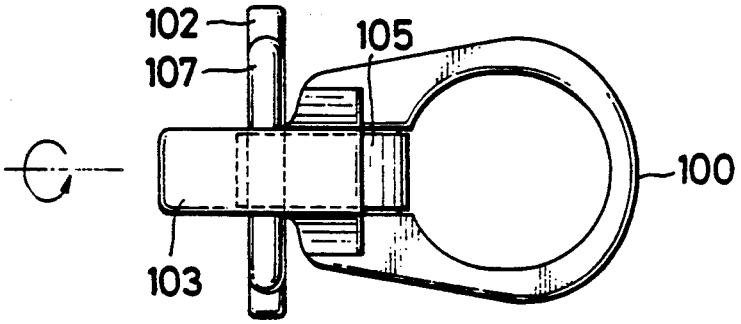
FIG. 7 RELATED ART
Figure 8:
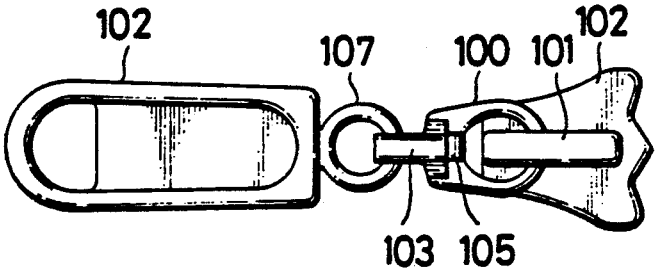
FIG. 8 RELATED ART

The hook 20 has a first recess 28 formed in the inner surface of the upper wall 21 and a second recess 29 formed in the distal end of the lower wall 22 for receptive engagement with the resilient member 27 as better shown in FIGS. 3 and 4.

The resilient member 27 thus supported in the hook 20 is in the form of a substantially U-shaped leaf spring which has an upper arm 30 and a lower arm 31 merged together by an arcuate joint 32. The upper arm 30 is provided at its distal end with an upwardly projecting claw 30', and the lower arm 31 is provided at its distal end with a downwardly slanted finger 31'.

The claw 30' and the finger 31' are snappingly received in and retained at the first recess 28 and the second recess 29, respectively, of the hook 20, with the arcuate joint 32 held in surrounding relation to the transverse bridge 18 of the clamper 11 as better shown in FIGS. 3 and 4.

The pull tab body 12 is in the form of a rod provided at one end 12' with a pair of ears 33, 33 diverging toward the clamper 11 and interconnected by a transverse pin 34 with which to displace the lower arm 31 of the resilient member 27 inwardly out of engagement with the second recess 29 of the hook 20 so as to engage the pull tab 12 with the clamper 11 as shown in FIGS. 3 and 4. The ears 33, 33 each have side peripheral walls **33*a*, 33*a* tapering off toward the pull tab end 12' and a substantially straight end surface 33*b* merging through rounded corners 33*c*, 33*c* with the side walls 33*a*, 33*a*. The ears 33, 33 are spaced apart by a distance substantially corresponding to the width of the hook 20 such that the pull tab 12 once connected to the clamper 11** is retained in place against lateral displacement.

The provision of the guide surfaces 19', 19' being tapered facilitates smooth sliding movement therealong of the ears 33, 33 of the pull tab 12 into the aperture 24 of the hook 20.

According to an important aspect of the invention, each of the ears 33, 33 has a geometry such that a distance B as measured between the end surface **33*b* and a tangent line 34*a* of the pin 34 extending in parallel with the end surface 33*b* is smaller than the width A of the opening 25 of the hook 20 and that a distance C as measured between the side peripheral wall 33*a* adjoining the corner 33*c* and a tangent line 34*b* of the pin 34 extending at right angles to the end surface 33*b* is larger than the width A of the opening 25 of the hook 20, as depicted in FIGS. 3 and 4. This geometric concept contributes to a maximum of ease with which to mount and dismount the pull tab 12 with respect to the clamper 11 and at the same time precludes the possibility of the pin 34 of the pull tab 12 jamming against and injuring the resilient member 27 even in the event the pull tab 12 is flipped down to undlie the clamper 11 as shown in FIG. 4**.

Obviously, various modifications and variations of the present invention are possible in the light of the above teaching. It is therefore to be understood that within the scope of the appended claims the invention may be practiced otherwise than as specifically described.

What is claimed is:

1. A pull tab assembly for slide fastener slider which comprises a clamper including an arcuate peripheral wall defining therein an aperture and a transverse bridge linking the confronting ends of said peripheral wall, a hook extending from said confronting ends and having its distal end terminating short of said bridge so as to define an opening, a resilient member supported in said hook, and a pull tab provided at one end with a pair of spaced ears interconnected by a pin, each of said ears having side peripheral walls and an end surface merging through corners with said side walls, and each of said ears having a geometry such that a distance as measured between said end surface and a tangent line of said pin extending in parallel with said end surface is smaller than the width of said opening of said hook and that a distance as measured between said side wall adjoining said corner and a tangent line of said pin extending at right angles to said end surface is larger than the width of said opening.

2. A pull tab assembly according to claim 1 wherein said ears are spaced apart by a distance substantially corresponding to the width of said hook.

3. A pull tab assembly according to claim 1 wherein said clamper has tapered guide surfaces at said confronting ends.

4. A pull tab assembly according to claim 1 wherein said pull tab is in the form of a rod.

5. A pull tab assembly according to claim 1 wherein said pair of ears diverge toward said clamper and taper off towrad said pull tab.

* * * * *